US010619617B2

(12) United States Patent
Sayama et al.

(10) Patent No.: US 10,619,617 B2
(45) Date of Patent: Apr. 14, 2020

(54) IGNITION DEVICE FOR INTERNAL COMBUSTION ENGINE

(71) Applicants: KABUSHIKI KAISHA TOYOTA CHUO KENKYUSHO, Nagakute-shi, Aichi-ken (JP); DENSO CORPORATION, Kariya, Aichi-pref. (JP)

(72) Inventors: Shogo Sayama, Nagakute (JP); Ryou Masuda, Nagakute (JP); Takayuki Fuyuto, Nagakute (JP); Masao Kinoshita, Nagakute (JP); Yoshihiro Nomura, Nagakute (JP); Akimitsu Sugiura, Kariya (JP)

(73) Assignees: KABUSHIKI KAISHA TOYOTA CHUO KENKYUSHO, Nagakute-shi (JP); DENSO CORPORATION, Kariya (JP)

( * ) Notice: Subject to any disclaimer, the term of this patent is extended or adjusted under 35 U.S.C. 154(b) by 79 days.

(21) Appl. No.: 15/893,175

(22) Filed: Feb. 9, 2018

(65) Prior Publication Data

US 2018/0238293 A1 Aug. 23, 2018

(30) Foreign Application Priority Data

Feb. 21, 2017 (JP) ..... 2017-030069

(51) Int. Cl.

| | |
|---|---|
| ***F02P 9/00*** | (2006.01) |
| ***F02P 17/12*** | (2006.01) |
| ***F02P 15/10*** | (2006.01) |
| ***F02D 35/02*** | (2006.01) |
| ***F23Q 23/00*** | (2006.01) |

(Continued)

(52) U.S. Cl.

CPC ..... *F02P 9/002* (2013.01); *F02D 35/02* (2013.01); *F02P 3/05* (2013.01); *F02P 9/007* (2013.01); *F02P 15/10* (2013.01); *F02P 17/12* (2013.01); *F23Q 23/00* (2013.01); *F02B 19/12* (2013.01); *F02P 2017/121* (2013.01); *H01F 38/12* (2013.01); *H01T 13/58* (2013.01)

(58) Field of Classification Search

CPC ..... F02P 9/002; F02P 17/12; F02P 2017/121
See application file for complete search history.

(56) References Cited

U.S. PATENT DOCUMENTS

| | | | | |
|---|---|---|---|---|
| 9,995,267 | B2 * | 6/2018 | Kondou | F02P 3/0435 |
| 2016/0047352 | A1 * | 2/2016 | Nakayama | F02P 3/0453 123/406.19 |

(Continued)

FOREIGN PATENT DOCUMENTS

| | | | |
|---|---|---|---|
| JP | 2013-024060 | A | 2/2013 |
| JP | 2015-200281 | A | 11/2015 |

OTHER PUBLICATIONS

Mar. 26, 2019 Office Action issued in Japanese Patent Application No. 2017-030069.

*Primary Examiner* — Thomas N Moulis
(74) *Attorney, Agent, or Firm* — Oliff PLC

(57) ABSTRACT

An ignition device for an internal combustion engine with an ignition plug that ignites an air-fuel mixture in a combustion chamber, wherein a discharge current i provided by the ignition plug to the air-fuel mixture is controlled to be greater than a discharge current reference value ibf, which is a minimum current value at which a spark discharge blow-out phenomenon does not arise.

2 Claims, 8 Drawing Sheets

(51) Int. Cl.

| | |
|---|---|
| ***F02P 3/05*** | (2006.01) |
| *H01F 38/12* | (2006.01) |
| *F02B 19/12* | (2006.01) |
| *H01T 13/58* | (2020.01) |

(56) References Cited

U.S. PATENT DOCUMENTS

| | | | | |
|---|---|---|---|---|
| 2017/0022957 | A1* | 1/2017 | Hayashi | F02P 3/045 |
| 2017/0117078 | A1* | 4/2017 | Kyouda | H01F 38/12 |

* cited by examiner

IGNITION DEVICE FOR INTERNAL COMBUSTION ENGINE

CROSS REFERENCE TO RELATED APPLICATION

The disclosure of Japanese Patent Application No. 2017-030069 filed on Feb. 21, 2017 including the specification, claims, drawings, and abstract is incorporated herein by reference in its entirety.

TECHNICAL FIELD

The present description relates to an ignition device for an internal combustion engine.

BACKGROUND

As conventionally known, an internal combustion engine is equipped with an ignition device (e.g., an ignition plug), which includes a central electrode (i.e., an ignition electrode), insulated and held by an insulator and paired with a confronting ground electrode, and is configured to generate a spark in response to a voltage applied between the central electrode and the ground electrode.

According to a conventional technique, if a secondary current value is lower than a predetermined threshold during a predetermined period of time since the start of spark discharging, it is determined that there has occurred a phenomenon that the flow of an air-fuel mixture extinguishes the spark discharge (hereinafter, referred to as "spark discharge blow-out phenomenon"), and supplementary spark discharging is continuously performed after the main discharge in the next cycle. In this case, it is said that setting the secondary current value to be a value obtainable by adding a predetermined current value to the predetermined threshold can prevent the spark discharge blow-out phenomenon from arising in the next cycle.

However, the above-mentioned conventional technique requires obtaining a current value at which the spark discharge is blown out in the previous cycle and setting the obtained value as a discharge current value in the next cycle. Accordingly, performing spark discharging without any current control is required in the previous cycle. Further, predicting whether the spark discharge is blown out is substantially difficult and therefore an unintended spark discharge blow-out phenomenon may easily arise.

SUMMARY

This description provides an ignition device for an internal combustion engine equipped with an ignition plug that ignites an air-fuel mixture in a combustion chamber, wherein a discharge current i provided by the ignition plug to the air-fuel mixture is controlled to be greater than a discharge current reference value $i_{bf}$, which is a minimum current value at which a spark discharge blow-out phenomenon does not arise.

Further, it is desired that the discharge current reference value $i_{bf}$ is set according to the following mathematical formula 1.

$$i_{bf}=kU^{n1}l_{spk}^{n2} \quad (1)$$

Further, it is desired to adjust the constant k within a range of 0.0017±10%, the constant $n_1$ within a range of 0.71±10%, and the constant $n_2$ within a range of 0.33±10% in mathematical formula (1).

BRIEF DESCRIPTION OF DRAWINGS

Embodiment(s) of the present disclosure will be described by reference to the following figures, wherein.

DESCRIPTION OF EMBODIMENTS

Figure 1:
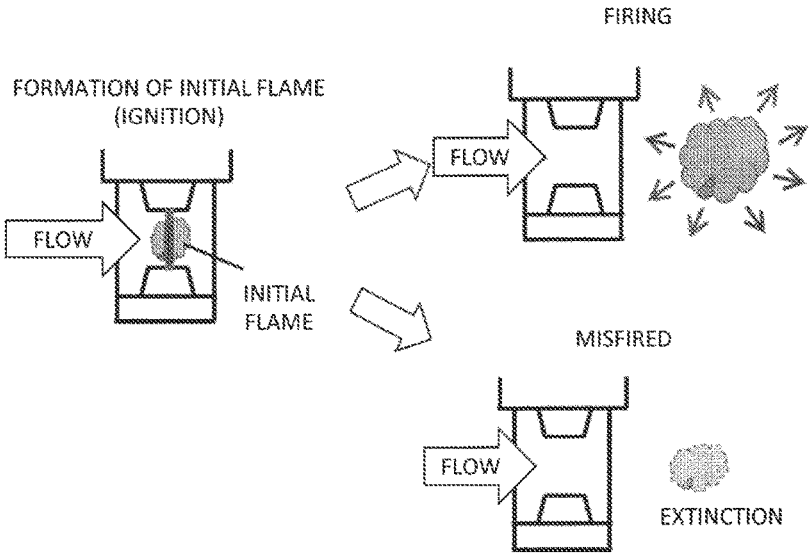
FIG. 1 illustrates the formation of a flame and the state of misfire in an ignition plug.

When an air-fuel mixture is ignited by a spark ignition device, such as an ignition plug, in an internal combustion engine, the burning velocity decreases in a case where the air-fuel mixture is highly diluted with air or exhaust gas recirculation (EGR) gas. Therefore, as illustrated in FIG. 1, even when an initial flame is formed by spark discharging, the flame may be later extinguished in its growth process, being caused by flame stretch. Accordingly, under the highly diluted condition, it is not only necessary to apply energy to the mixture so that the initial flame can be formed but also it is necessary to set the level of the applied energy to be sufficient to prevent the initial flame from being extinguished in its growth process.

Figure 2:
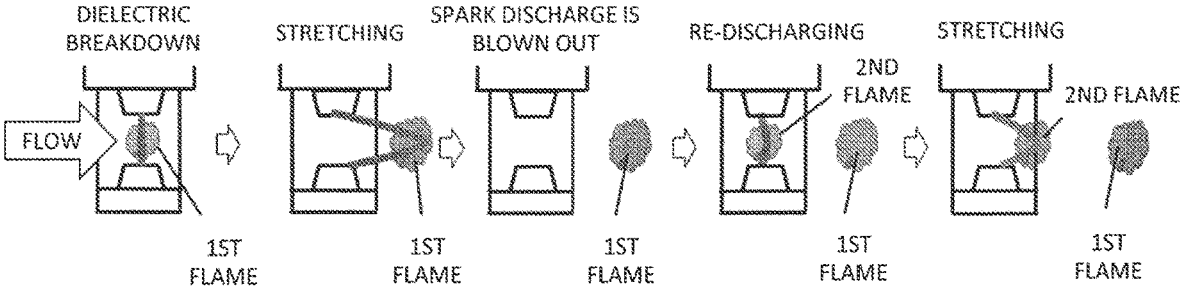
FIG. 2 illustrates a spark discharge path and the state of a flame in a case where an air-fuel mixture is flowing.

When a flow of air-fuel mixture is present in a combustion chamber of an internal combustion engine, a spark discharge path grows following the airflow after dielectric breakdown by the spark discharge. In this case, the discharge path does not continue to grow uniformly. This is because the spark discharge is once blown out during its growth, and re-discharging arises somewhere between the electrodes, as illustrated in FIG. 2. The energy can be input to the same volume when the discharge path is uniformly growing. However, when the spark discharge is once blown out and the re-discharging arises subsequently, the energy may heat another volume. The ignition will be established if the input energy is sufficient for the initial flame to propagate autonomously after the spark discharge is blown out. If the energy is insufficient, the flame will be extinguished at a downstream side thereof and will not contribute to the ignition. In other words, frequent occurrences of re-discharging in the discharge period are likely to generate many initial flames. The generated flames tend to extinguish at the downstream side and do not sustain the ignited state. From the reason described above, it can be concluded that suppressing the spark discharge blow-out phenomenon in the discharge period and promoting the stretching of the discharge path can improve ignition performances under highly diluted conditions. When diffusion of electrons and positive ions is taken into consideration in a spark discharge process under a circumstance that the presence of a flow is not negligible, a minimum current value $i_{bf}$ is required to sustain the spark discharge. The longer the discharge path, the more the electrons and the positive ions are exposed to the flow field for a long period of time and diffuse, making it difficult to sustain the spark discharge. Accordingly, it is believed that the current value $i_{bf}$ is proportional to a discharge path length $l_{spk}$, as expressed by the following mathematical formula 2.

$$i_{bf}=\alpha l_{spk}^{n} \quad (2)$$

In mathematical formula 2, "α" and "n" are constants.

For the purpose of experimentally proving that the mathematical formula (2) is applicable, visualization of discharge behavior in the flow field of an air-fuel mixture and measurement of discharge current were performed.

Figure 3:
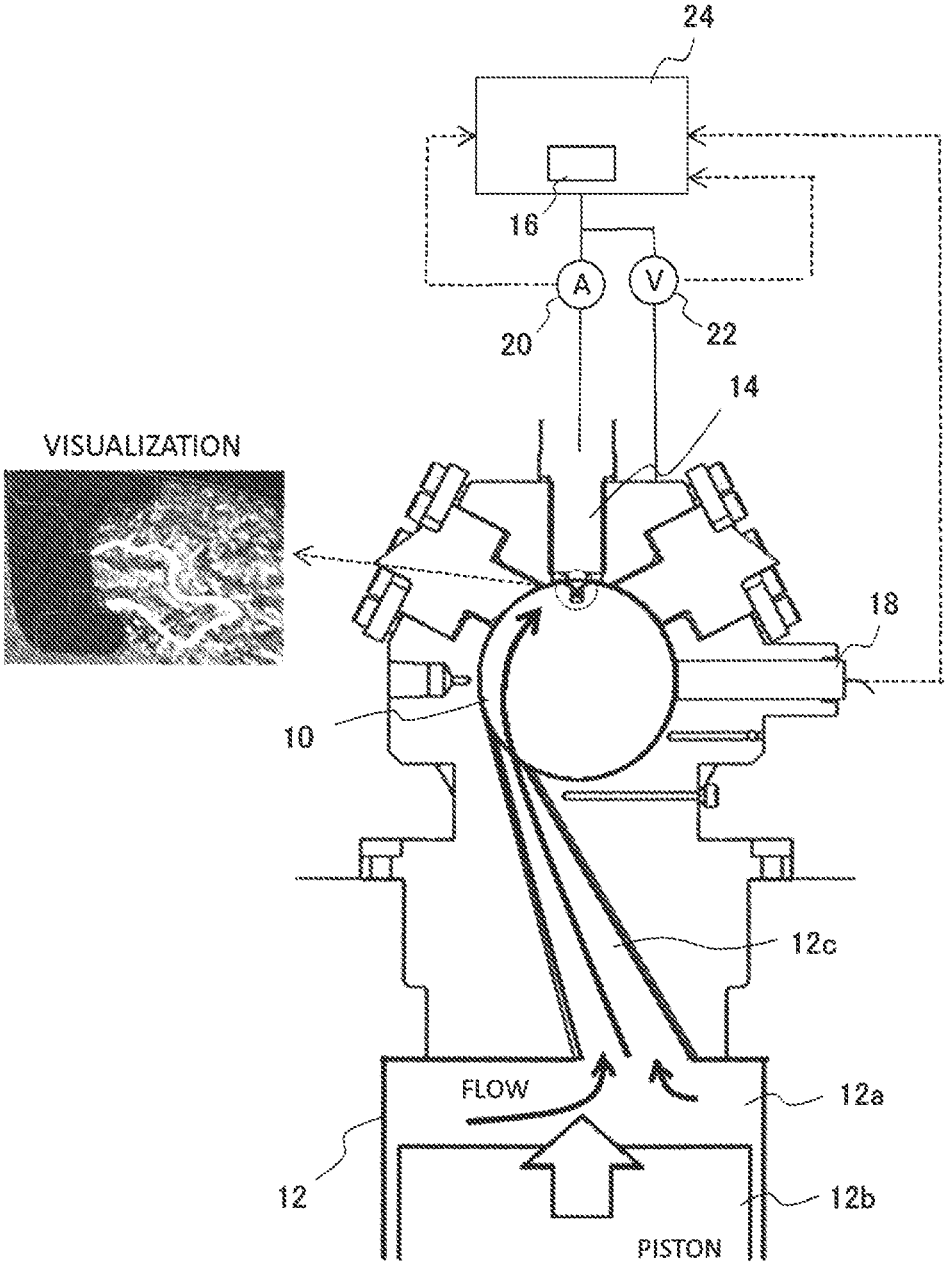
FIG. 3 illustrates a configuration of a combustion testing apparatus according to an embodiment.

FIG. 3 schematically illustrates a testing apparatus, which includes a combustion chamber 10, a fuel supply device 12, an ignition plug 14, a power supply unit 16, a pressure sensor 18, a current sensor 20, a voltage sensor 22, and a control unit 24. The fuel supply device 12 includes a combustion chamber 12*a* in which supplied fuel is mixed with air, a piston 12*b* that expels the air-fuel mixture out of the combustion chamber 12*a*, and a fuel supply tube 12*c* via which the air-fuel mixture is conveyed into the combustion chamber 10. The fuel supply tube 12*c* is arranged in such a manner that a transversal flow of the air-fuel mixture can be formed between the central electrode and the ground electrode of the ignition plug 14. According to the example illustrated in FIG. 3, the flow of the air-fuel mixture is formed along a cylindrical wall surface of the combustion chamber 10, so that the flow of the air-fuel mixture is transversal with respect to a gap formed between the central electrode and the ground electrode of the ignition plug 14.

The power supply unit 16 applies a high voltage to the central electrode of the ignition plug 14. The power supply unit 16 includes a boosting circuit, which includes a capacitor and a coil, and is configured to apply the high voltage to the central electrode of the ignition plug 14 when a switching element connected to the coil is turned on.

The current sensor 20 detects current supplied to the ignition plug 14 and outputs a detected current value to the control unit 24. The voltage sensor 22 detects voltage applied between the central electrode and the ground electrode of the ignition plug 14 and outputs a detected voltage value to the control unit 24. The control unit 24 controls each constituent component provided in the testing apparatus. The control unit 24 includes a power circuit that supplies electric power to the ignition plug 14, so that ignition and combustion of the air-fuel mixture can be caused in the combustion chamber 10 when the voltage is applied between the central electrode and the ground electrode of the ignition plug 14. Further, the control unit 24 acquires detection values (i.e. the current value and the voltage value) from the current sensor 20 and the voltage sensor 22 and outputs these detection values.

Further, the testing apparatus according to the present embodiment has a configuration such that a region including the vicinity of the ignition plug 14 can be observed. More specifically, the testing apparatus includes a viewing port with a sapphire glass fitted thereto, and is configured to enable a user to observe a combustion state of the air-fuel mixture in the vicinity of the ignition plug 14. More specifically, as illustrated in FIG. 3, capturing a still image or a moving image of the combustion state is feasible.

Figure 4:
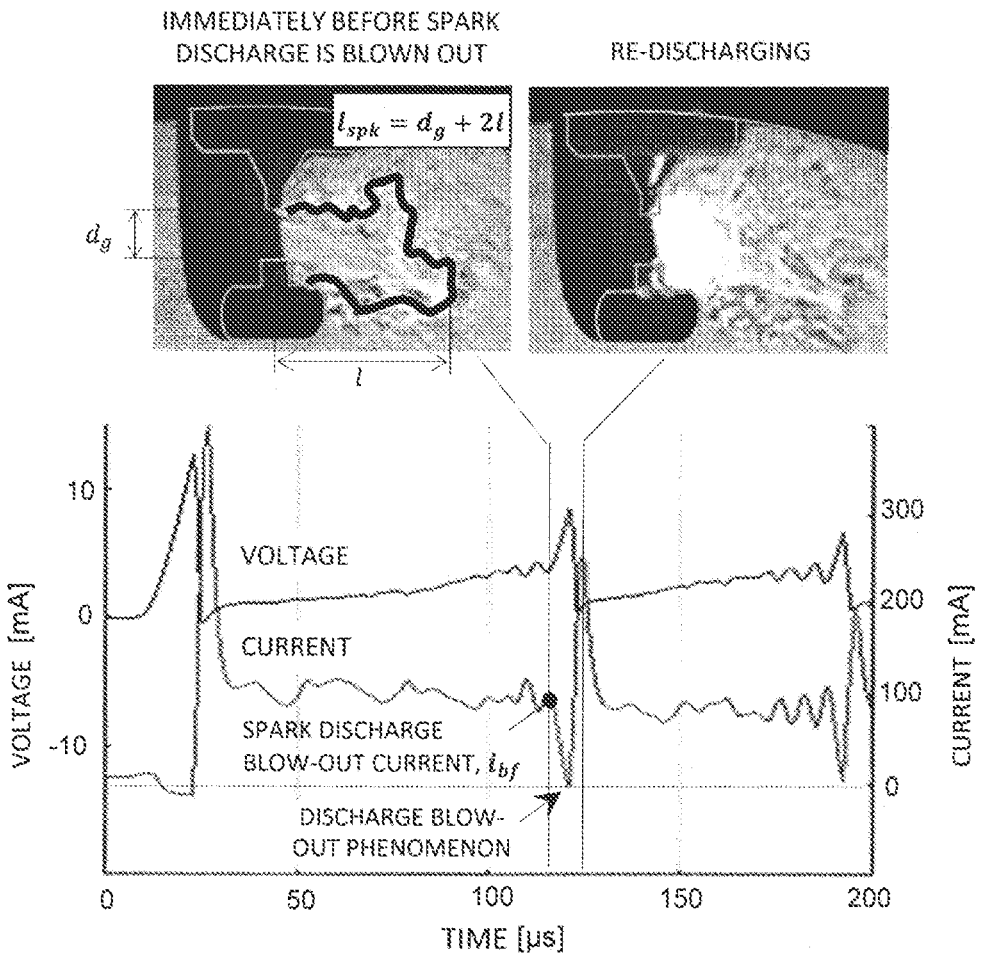
FIG. 4 illustrates a combustion testing method according to an embodiment.

FIG. 4 illustrates examples of observation images at the time of ignition and combustion of the air-fuel mixture in the combustion chamber 10 of the testing apparatus and temporal changes of the current value and the voltage value. The voltage is applied to the ignition plug 14 when approximately 10 μs has elapsed after starting the measurement, and the voltage applied to the ignition plug 14 abruptly decreases when approximately 25 μs has elapsed, while the current flowing across the ignition plug 14 increases. More specifically, this indicates that dielectric breakdown has occurred in the air-fuel mixture at this point. Subsequently, when approximately 115 μs has elapsed, the voltage value increases again and the current value decreases. This indicates that the spark discharge blow-out phenomenon has occurred at this point. Subsequently, when approximately 125 μs has elapsed, the voltage value decreases again and the current value increases. This indicates that spark discharge has occurred in the air-fuel mixture at this point. As mentioned above, the ignition process proceeds while it is accompanied by the spark discharge blow-out phenomenon and the re-discharging occurring alternately.

In the present embodiment, the state of ignition and combustion in the combustion chamber 10 was observed, and the current ibf at the occurrence of spark discharge blow-out phenomenon and the discharge path length $l_{spk}$ at that time were extracted from the observation result. Assuming that the spark discharge path forms a rectangular U shape, the discharge path length lspk is believed to be equivalent to dg+2l, in which "dg" represents a gap between the electrodes and "l" represents a distance between a distal end of a discharge region and a midpoint between the electrodes.

Figure 5:
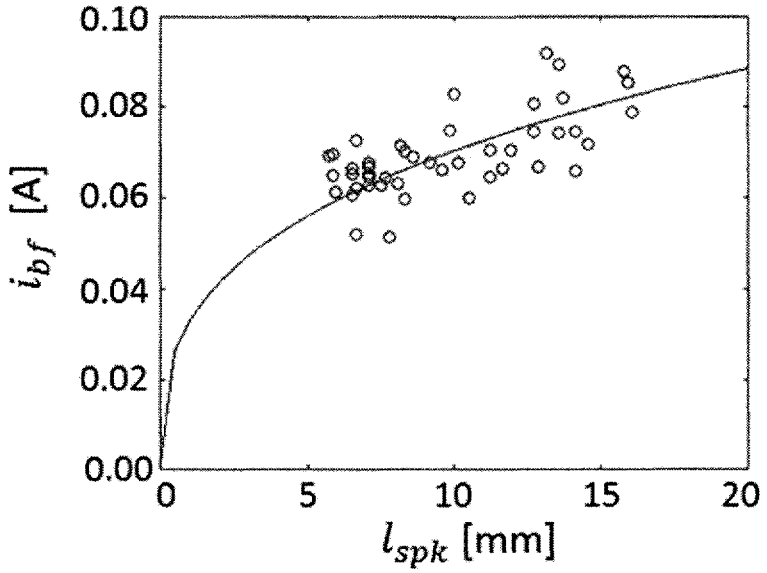
FIG. 5 is a graph illustrating an exemplary relationship between the discharge path length and the current.

FIG. 5 illustrates a relationship between the current ibf and the discharge path length $l_{spk}$, which was obtained from measurement results. From FIG. 5, it is understood that the current $i_{bf}$ changes depending on the discharge path length $l_{spk}$, and the above-mentioned mathematical formula (2) is applicable.

Next, to determine the constants "α" and "n" of mathematical formula (2), similar tests were conducted for a plurality of different conditions, in which variable parameters are pressure, inter-electrode flow velocity, and air-fuel mixture composition. Regarding detailed ranges of the test conditions, the ignition energy is 200 mJ, the pressure is not less than 10 bar and not greater than 15 bar, and the inter-electrode flow velocity is not less than 52 m/s and not greater than 78 m/s. Further, the air-fuel mixture composition ratio (air/fuel ratio) is not less than 15 and not greater than 26, and the EGR rate is not less than 0 and not greater than 31%.

The test results have revealed that the constant α is dependent on the inter-electrode flow velocity U. Therefore, mathematical formula (2) was rewritten into the following mathematical formula (3).

$$i_{bf}=kU^{n1}l_{spk}^{n2} \quad (3)$$

In mathematical formula (3), "k," "$n_1$," and "$n_2$" are constants.

A result of fitting the test results using mathematical formula (3) indicates that setting the constant values to be k=0.0017[A], $n_1$=0.71, and $n_2$=0.33 is desirable. Optimum values of the constants k, $n_1$, and $n_2$ are somewhat variable depending on the shape of the ignition plug 14, and it is desired to set an adjusting range of approximately ±10% for respective values.

Figure 6:
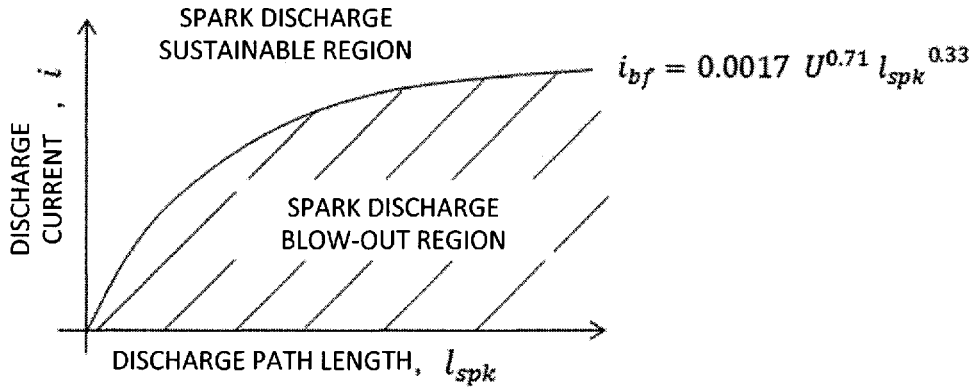
FIG. 6 is a graph illustrating an exemplary reference line that can prevent the spark discharge blow-out phenomenon in the relationship between the discharge path length and the current.

Accordingly, as illustrated in FIG. 6, preventing the spark discharge blow-out phenomenon is feasible when a discharge current value i obtained by fitting the constants k=0.0017[A], $n_1$=0.71, $n_2$=0.33 to the mathematical formula (3) is controlled to be greater than the reference value $i_{bf}$.

It is desired to perform the control according to the following procedure. The control includes step (1) in which the present discharge path length is obtained based on the voltage value and the current value, step (2) in which the discharge current reference value $i_{bf}$ is obtained from the mathematical formula (3), and step (3) in which the present current value i is compared with the discharge current reference value $i_{bf}$ and, if the discharge current i is insufficient, the current value i is increased.

Figure 7:
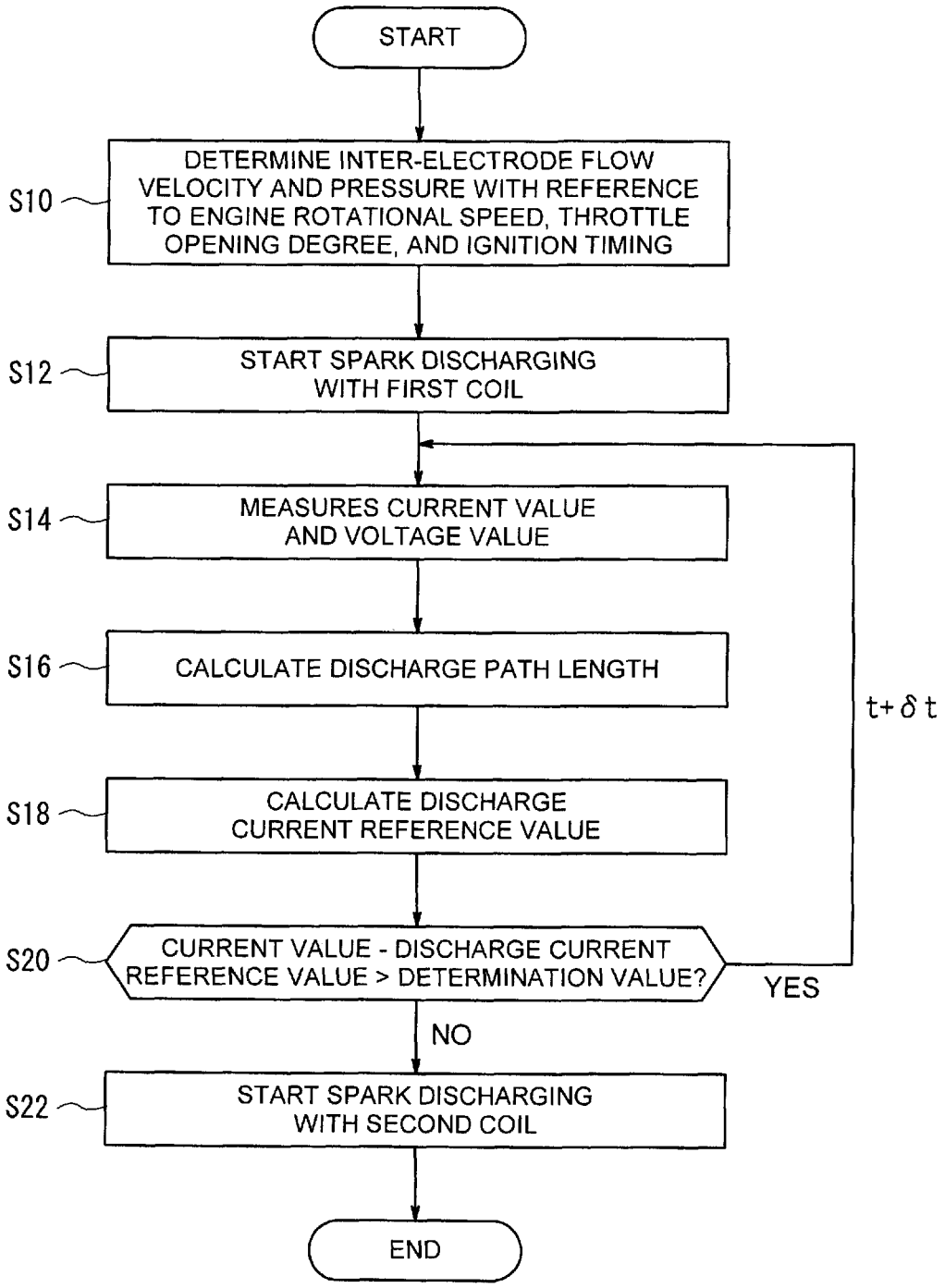
FIG. 7 is a flowchart illustrating a discharge control method according to an embodiment.

More specifically, it is desired to perform the control according to a flowchart illustrated in FIG. 7. The present example includes an ignition circuit configured to apply discharge voltage to the ignition plug 14 at independent timing. For example, the ignition circuit may include two coils connected in parallel so that the discharge voltage can be applied from each coil to the ignition plug 14 at independent timing.

In step S10, the control unit 24 obtains the inter-electrode flow velocity U [m/s] and the combustion chamber interior pressure p [bar] with reference to the present engine rotational speed Ne, throttle opening degree TH, and ignition timing IGT. It is desired to obtain beforehand a map indicating the inter-electrode flow velocity U [m/s] and the combustion chamber interior pressure p [bar] for a plurality of combinations of the rotational velocity Ne, the throttle opening degree TH, and the ignition timing IGT, for each model of the internal combustion engine, so that the control unit 24 can determine the inter-electrode flow velocity U [m/s] and the combustion chamber interior pressure p [bar] with reference to the map.

In step S12, according to the ignition timing IGT the control unit 24 turns on the first coil to cause the ignition plug 14 to start spark discharging.

In step S14, the control unit 24 measures a current value i(t) and a voltage value V(t) on the secondary side of the ignition circuit.

In step S16, the control unit 24 calculates the discharge path length $l_{spk}$ based on the measured values of the current value i(t) and the voltage value V(t). The following mathematical formula (4) can be referred to in obtaining the discharge path length $l_{spk}$. Mathematical formula (4) was derived from tests using the testing apparatus illustrated in FIG. 3.

$$l_{spk}=0.017p^{-0.51}i(t)^{0.10}\{v(t)-i(t)R_{plug}\} \quad (4)$$

In mathematical formula (4), $R_{plug}$ is an internal resistance value of the ignition plug 14.

In step S18, the control unit 24 calculates the discharge current reference value $i_{bf}$ by substituting the discharge path length $l_{spk}$ obtained in step S16 and the inter-electrode flow velocity U into mathematical formula (3). The constants are, for example, k=0.0017 [A], $n_1$=0.71, and $n_2$=0.33.

In step S20, the control unit 24 compares the present current value i(t) with the discharge current reference value $i_{bf}$. If the value obtained by subtracting the discharge current reference value $i_{bf}$ from the discharge current i(t) is greater than a determination value β (YES in step S20), the control unit 24 increases the time from t to t+δt and the processing returns to step S14. If the obtained value is not greater than the determination value β (NO in step S20), the processing proceeds to step S22. It is desired that the determination value β is set while considering the necessity of margin of the discharge current i(t) with respect to the discharge current reference value $i_{bf}$. More specifically, the determination value β is a margin (safety margin) and it is desired that the determination value β is not less than 0. For example, setting the determination value β to be not less than 10 mA and not greater than 30 mA is desired.

In step S22, the control unit 24 turns on the second coil to increase the discharge current i(t) from the ignition plug 14, thereby compensating for the shortage of the discharge current i(t).

Figure 8:
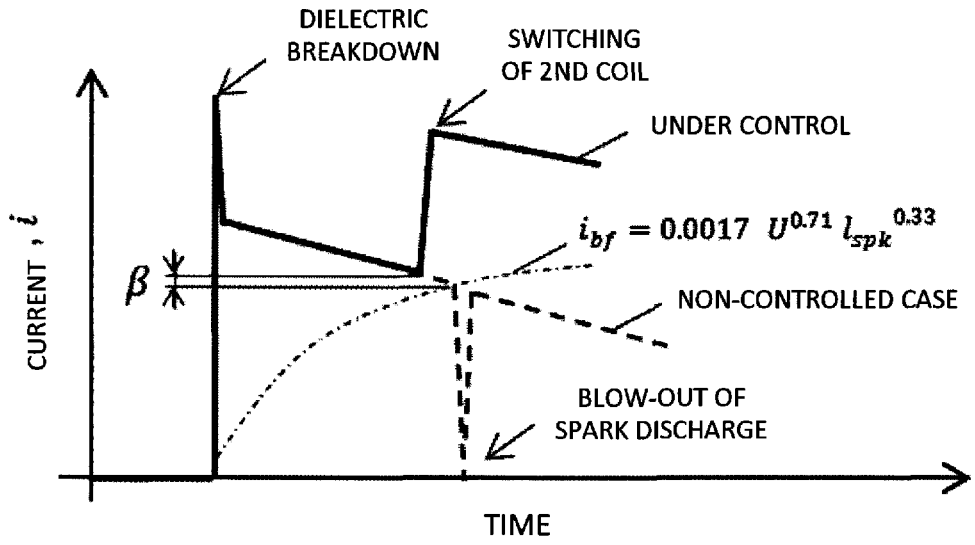
FIG. 8 is a graph illustrating a temporal change of the current when the discharge control according to the embodiment is applied.
Figure 9:
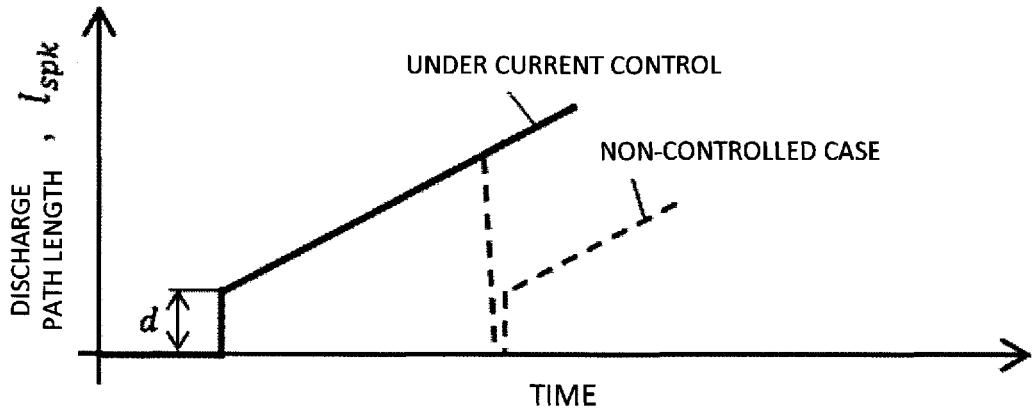
FIG. 9 is a graph illustrating a temporal change of the discharge path length when the discharge control according to the embodiment is applied.

FIG. 8 illustrates a temporal change of the discharge current i(t) when the above-mentioned control has been performed, and FIG. 9 illustrates a corresponding temporal change of the discharge path length $l_{spk}$. In FIGS. 8 and 9, solid lines indicate the changes observed when the present control has been applied, and dotted lines indicate the changes under non-application of the control. When the control according to the present embodiment is applied, the discharge current i(t) is constantly greater than the discharge current reference value $i_{bf}$ so that the spark discharge blow-out phenomenon can be prevented. Further, the discharge path length $l_{spk}$ continuously increases with elapsing time.

As described above, the control method according to the present embodiment can prevent the spark discharge blow-out phenomenon and does not require the discharging to be performed in advance without any current control. Accordingly, eliminating the occurrence of an unintended spark discharge blow-out phenomenon is feasible.

Although the ignition circuit according to the present embodiment includes two coils (i.e., the first coil and the second coil) for the discharge control of the ignition plug 14, the total number of the coils may be increased if desirable. In such a case, the control unit 24 may repeat the processing in steps S14 to S22 for each of the increased coils in accordance with increase of time t.

Modified Example

Figure 10:
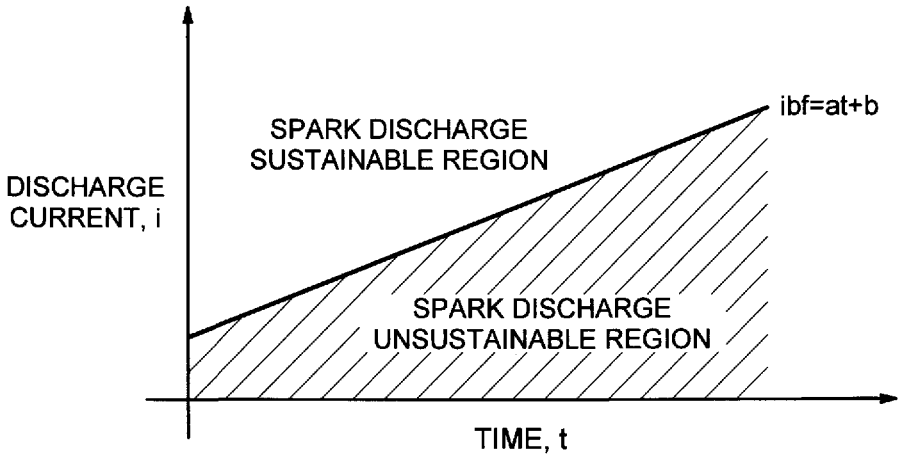
FIG. 10 illustrates an exemplary reference line that can prevent the spark discharge blow-out phenomenon in the relationship between the time and the current.

The scope of this description is not limited to the above-mentioned embodiment, in which the discharge current reference value $i_{bf}$ is calculated based on mathematical formula (3). For example, as illustrated in the following mathematical formula (5), the discharge current reference value $i_{bf}$ may be set as a linear function proportional to time t (see FIG. 10), in which "a" is a proportional constant and "b" is an intercept, which can be determined beforehand according to the configuration of the internal combustion engine.

$$i_{bf}=at+b \quad (5)$$

Further, replacing mathematical formula (4) with the following mathematical formula (6) will obtain similar effects. Mathematical formula (6) is referred to as expression of Kim & Anderson (Kim J. & Anderson R. W. (1995) Spark anemometry of bulk gas velocity at the plug gap of a firing engine (No. 952459). SAE Technical Paper). In this case, in the above-mentioned step S16, the control unit 24 may apply mathematical formula (6) instead of using mathematical formula (4).

$$l_{spk}=0.025p^{-0.51}i(t)^{0.32}\{v(t)-i(t)R_{plug}\} \quad (6)$$

Although the above-mentioned embodiment uses an actually measured value of the inter-electrode flow velocity U, it may be feasible to calculate the inter-electrode flow velocity U from the discharge path length $l_{spk}$. More specifically, the following mathematical formula (7) can be used to calculate the inter-electrode flow velocity U from a change of the discharge path length $l_{spk}$ with respect to the time t.

$$U = \frac{l_{spk}(t) - l_{spk}(t - \delta t)}{2\delta t} \tag{7}$$

In this case, in step S10, the control unit 24 may determine only the combustion chamber interior pressure p and, in step S16, the control unit 24 may calculate the discharge path length $l_{spk}$ and calculate the inter-electrode flow velocity U using mathematical formula (7).

Although the above-mentioned embodiment includes measurements of both the current value i(t) and the voltage value V(t), it may be the case that only the current value i(t) is measured when the voltage value V(t) can be calculated from the measured current value i(t).

The following mathematical formula (8) is employable to express the current value i(t) from a relational expression of electromagnetics, in which E(t) is residual ignition energy and Ls is coil inductance.

$$i(t) = \sqrt{\frac{2E(t)}{L_s}} \tag{8}$$

Differentiating mathematical formula (8) derives the following mathematical formula (9).

$$\frac{d}{dt}i(t) = \sqrt{\frac{1}{2L_s}}\, E(t)^{-\frac{1}{2}}\left\{\frac{d}{dt}E(t)\right\} \tag{9}$$

Further, because the following relationship between mathematical formula (10) and mathematical formula (11) is established, it is feasible to rewrite mathematical formula (9) into the following mathematical formula (12), in which E0 is total ignition energy.

$$\frac{d}{dt}E(t) = i(t)V(t) \tag{10}$$

$$E(t) = E_0 - \int_0^t i(\tau)V(\tau)d\tau \tag{11}$$

$$\begin{aligned}\frac{d}{dt}i(t) &= \sqrt{\frac{1}{2L_s}}\, i(t)V(t)\left\{E_0 - \int_0^t i(\tau)V(\tau)d\tau\right\}^{-\frac{1}{2}} \\ &= \sqrt{\frac{1}{2L_s}}\, i(t)V(t)\{E_0 - Q_{tot}(t)\}^{-\frac{1}{2}}\end{aligned} \tag{12}$$

Mathematical formula (12) can be rearranged with respect to the voltage value V(t) to obtain the following mathematical formula (13). Mathematical formula (13) can be used to calculate the voltage value V(t) from the current value i(t).

$$V(t) = \sqrt{2L_s\{E_0 - Q_{tot}(t)\}}\, i(t)\left\{\frac{di(t)}{dt}\right\} \tag{13}$$

Figure 11:
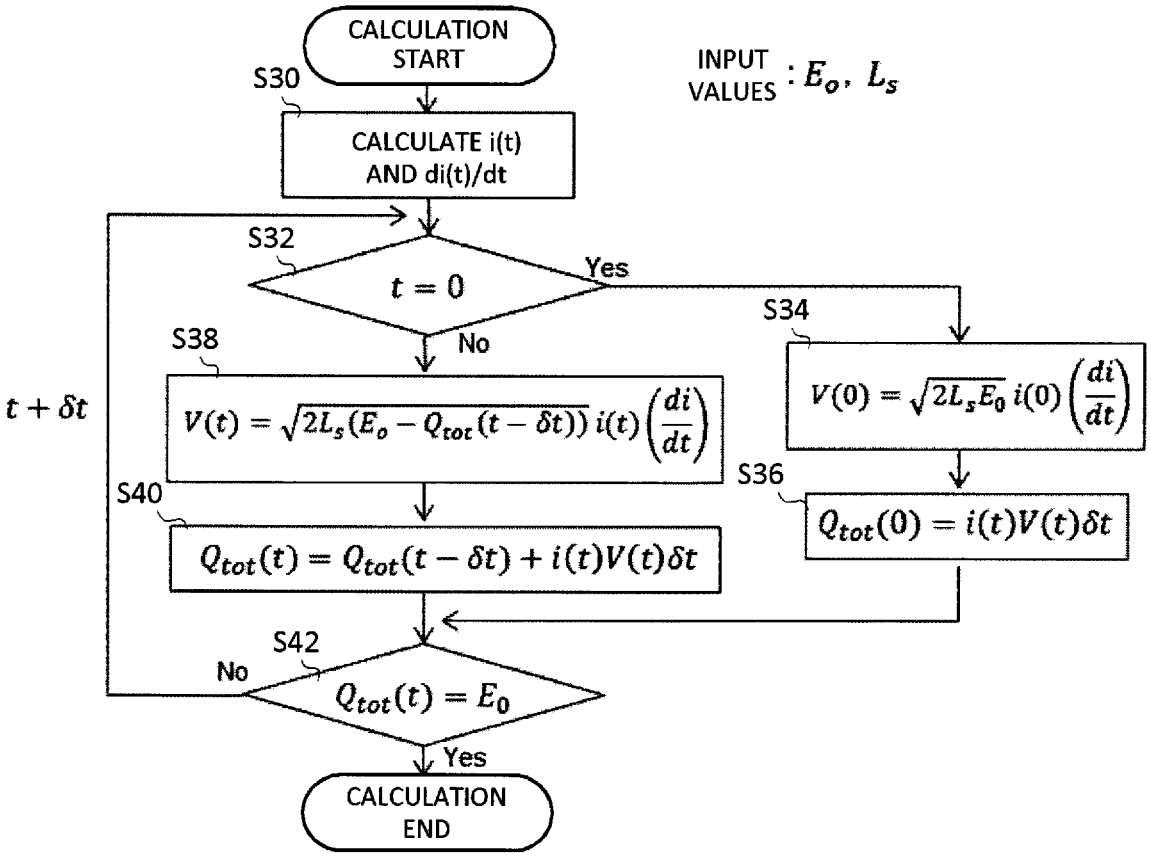
FIG. 11 is a flowchart illustrating a method for calculating a voltage value from a current value.

More specifically, the voltage value V(t) can be calculated according to a flowchart of a calculation method illustrated in FIG. 11.

In step S30, the control unit 24 calculates the current value i(t) and a time differential value di(t)/dt of the current value i(t). In step S32, the control unit 24 determines whether the time t is initial value 0. If the time t is 0 (YES in step S32), the processing proceeds to step S34. If the time t is not 0, the processing proceeds to step S38. In this case, it is desired that the time t=0 is set at a time shifted by an arbitrary time from the start time of dielectric breakdown.

In step S34, the control unit 24 calculates a voltage value V(0), which is an initial value of the voltage value V(t), according to the following mathematical formula (14) that is obtainable by substituting time t=0 into mathematical formula (13).

$$V(0)=\sqrt{2L_sE_0}\,i(0) \tag{14}$$

In step S36, the control unit 24 calculates a value Qtot(0) at time t=0 according to the follow mathematical formula (15).

$$Q_{tot}(0)=i(t)V(t)\delta t \tag{15}$$

On the other hand, if the time t is not 0 (NO in step S32), the processing proceeds to step S38, in which the control unit 24 calculates the voltage value V(t) according to the following mathematical formula (16), which can be obtained by substituting a value Qtot(t−δt) at previous time (t−δt) into mathematical formula (13). Then, in step S40, the control unit 24 calculates a value Qtot(t) at the present time t.

$$V(t) = \sqrt{2L_s\{E_0 - Q_{tot}(t - \delta t)\}}\, i(t)\left\{\frac{di(t)}{dt}\right\} \tag{16}$$

In step S42, the control unit 24 determines whether the value Qtot(t) is equal to the total ignition energy E0. If the value Qtot(t) is equal to the total ignition energy E0 (YES in step S42), the control unit 24 terminates the calculation processing and performs the control by using the voltage value V(t) calculated at this timing. If the value Qtot(t) is not equal to the total ignition energy E0 (NO in step S42), the control unit 24 increases the time t by an amount δt and the processing returns to step S32.

As described above, it is feasible to prevent the spark discharge blow-out phenomenon, and the discharge to be performed in advance without any current control is unnecessary. As a result, the ignition device for an internal combustion engine can eliminate the occurrence of an unintended spark discharge blow-out phenomenon.

The invention claimed is:

1. An ignition device for an internal combustion engine equipped with an ignition plug that ignites an air-fuel mixture in a combustion chamber, wherein:

a discharge current i provided by the ignition plug to the air-fuel mixture is controlled to be greater than a discharge current reference value $i_{bf}$, which is a minimum current value at which a spark discharge blow-out phenomenon does not arise; and the discharge current reference value $i_{bf}$ is set according to the following mathematical formula:

$i_{bf}=kU^{n1}l_{spk}^{n2}$, wherein:

$l_{spk}$ is discharge path length;

k, n1 and n2 are constants; and

U is inter-electrode flow velocity.

2. The ignition device for an internal combustion engine according to claim 1, wherein k is a constant that is adjustable within a range of 0.0017±10%, $n_1$ is a constant that is adjustable within a range of 0.71±10%, and $n_2$ is a constant that is adjustable within a range of 0.33±10%.

* * * * *